US006474078B2

(12) United States Patent
Chalk et al.

(10) Patent No.: US 6,474,078 B2
(45) Date of Patent: Nov. 5, 2002

(54) PUMPING SYSTEM AND METHOD FOR PUMPING FLUIDS

(75) Inventors: David Jonathan Chalk, Slatington; Donald Earl Thompson, Schnecksville; John Francis Fischl, Wescosville; David John Farese, Riegelsville, all of PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/825,784

(22) Filed: Apr. 4, 2001

(65) Prior Publication Data

US 2002/0144509 A1 Oct. 10, 2002

(51) Int. Cl.[7] ..... F17C 9/02
(52) U.S. Cl. ..... 62/50.5; 62/50.7
(58) Field of Search ..... 62/50.2, 50.5, 62/50.7

(56) References Cited

U.S. PATENT DOCUMENTS

| | | | | |
|---|---|---|---|---|
| 2,362,724 A | | 11/1944 | Shea | |
| 3,630,639 A | | 12/1971 | Duron et al. | 417/53 |
| 4,277,950 A | * | 7/1981 | Eigenbrod et al. | 62/55 |
| 4,472,946 A | | 9/1984 | Zwick | 62/55 |
| 4,860,545 A | | 8/1989 | Zwick et al. | 62/50.6 |
| 5,160,769 A | | 11/1992 | Garrett | 428/36.5 |
| 5,218,827 A | | 6/1993 | Pevzner | 62/50 |
| 5,353,849 A | | 10/1994 | Sutton et al. | 141/44 |
| 5,411,374 A | | 5/1995 | Gram | 417/53 |
| 5,537,828 A | | 7/1996 | Borcuch et al. | 62/50.1 |
| 5,819,544 A | | 10/1998 | Andonian | 62/50.6 |
| 6,044,647 A | * | 4/2000 | Drube et al. | 62/50.1 |

* cited by examiner

*Primary Examiner*—William C. Doerrler
*Assistant Examiner*—Malik N. Drake
(74) *Attorney, Agent, or Firm*—Willard Jones, II

(57) ABSTRACT

An apparatus for transferring fluid from a vessel includes a pump, a first conduit, and a control means in fluid communication with the pump and having open and closed positions. The first end of the conduit is in fluid communication with the vessel and a second end of the conduit is in fluid communication with an inlet of the pump. The control means alternates between the open and the closed positions, whereby a stream of fluid flows into the pump inlet from the conduit when the control means first alternates to the open position, the control means alternates to the closed position and the fluid vaporizes in the pump thereby forming a vaporized portion of the fluid, and a stream of the vaporized portion of the fluid flows out of a pump outlet when the control means alternates again to the open position.

25 Claims, 4 Drawing Sheets

PUMPING SYSTEM AND METHOD FOR PUMPING FLUIDS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention generally relates to systems and methods for transferring fluids from a vessel to another location or an end user, and more particularly to a system and method for pumping cryogenic fluids from a vessel to another location or an end user.

In general, past attempts to optimize cryogenic pump systems have fallen short of providing an economical and effective means of cooling the pump and minimizing product waste. Most cryogenic pumps in service have no insulation on the inlet line or on the vapor return line. These systems have proven to be wasteful of cryogen, often venting and losing substantial product. To ensure that these systems operate without cavitating, the systems generally have a vacuum jacketed sump at the inlet of the pump that acts as a phase separator. Also, the pump must be cooled down to an appropriate level with a minimum of wasted product.

One way to reduce product losses is to insulate the inlet and/or vapor return lines. This not only helps to reduce losses, but also improves pump performance. However, there are drawbacks to insulating the piping. If the vapor return line is not insulated, there will be liquid cryogen in this line which will boil off and add to the vent losses of the system. For vacuum jacketed piping, the cost of the piping can exceed the cost of the pump itself. If insulated with foam insulation, the foam is subject to thermal cycling which damages the foam and draws in moisture. Freezing of water inside the insulation can result in higher heat leak rates than an uninsulated line.

Others have attempted to overcome these deficiencies in the prior art. Various prior art systems which have attempted to reduce product losses and/or overcome the other above-described deficiencies are discussed below.

One prior art method is to submerge the pump in a supply tank or vessel so that the pump is always cold. Losses for this type of system are primarily due to heat leak of the vessel and heat generation of the pump.

U.S. Pat. Nos. 4,472,946 (Zwick) and 4,860,545 (Zwick, et al.) disclose a cryogenic storage tank with a built-in submerged pump that is kept in a continuously cooled down state by the cryogen stored in the tank such that pumping may be commenced immediately. This approach attempts to reduce the loss of cryogen through boil-off by minimizing the heat leak path from the environment into the cryogen caused by the presence of the pump inside the tank. This is done by providing an insulated cryogenic storage vessel with a pump mounting tube extending into the vessel and immersed in the cryogen. The outer surface of the pump mounting tube within the vessel is insulated so as to minimize the heat leakage from the pump mounting tube to the cryogen surrounding the tube. However, there are several drawbacks to this design, which in general is impractical.

First, there is the requirement of a special tank in which to install the pump. Second, to repair the pump, the tank pressure must be vented and the pump removed and warmed up before repairs can be made. Overall, the costs associated with this design are unacceptable.

U.S. Pat. No. 5,819,544 (Andonian) discloses a high pressure pumping system for pumping cryogenic liquid from a low pressure holding cylinder to a high pressure gas cylinder (or other high pressure utilization system). The system includes a high pressure piston pump having a unidirectional flow input and a unidirectional flow output immersed in the cryogenic liquid in a low pressure pump container that is fed cryogenic liquid from the low pressure holding cylinder. The pressure in the pump container is maintained so that driving the pump piston pumps cryogenic liquid from the bulk tank to the high pressure utilization system. Although this design is more economical than the cryogenic storage tank with built-in pump by Zwick, it has other problems. For example, the smaller tank must be filled periodically. This results in vent losses due to blowing down of the vessel and line heating. Further complications are added because of the controls needed to accomplish tank filling without the pump having to shut down.

U.S. Pat. No. 5,218,827 (Pevzner) discloses a method and apparatus for supplying liquified gas from a vessel to a pump with subcooling so as to avoid cavitation during pumping. No attempt is made to minimize product losses, only to provide a subcooled liquid to the pump. Problems associated with vent losses are largely ignored.

U.S. Pat. No. 5,537,828 (Borcuch, et aL) discloses a temperature-based cryogenic pump cooldown system wherein the suction or input conduit to the cryogenic pump and the cryogenic pump itself are sequentially cooled prior to pumping. This system also ignores problems associated with vent losses, focusing primarily on how the pump is effectively cooled down and how that cool down is monitored and controlled.

U.S. Pat. No. 5,411,374 (Gram) discloses a cryogenic fluid pump system and method of pumping cryogenic fluid. The system is intended primarily for LNG, although it discusses other cryogenic fluids. It does not discuss insulating the lines, nor does it discuss a conventional vapor return line. The pump is required to pump vapor and liquid separately out of the inlet line. Cooldown of the pump is accomplished by recirculating the cryogenic fluid back to the top of the supply tank, which is not an uncommon practice.

U.S. Pat. No. 5,353,849 (Sutton, et al.) discloses another method of operating a cryogenic pump, which is complicated by additional methodology used to meter the cryogenic fluid. The method used to cool down the pump is similar to that in U.S. Pat. No. 5,411,374 (Gram). A liquid sensor (e.g., a temperature probe) indicates when cryogenic liquid has gone through the pump. When the probe indicates liquid downstream of the pump, there is a time delay before the pump is started.

U.S. Pat. No. 5,160,769 (Garrett) discloses a method to minimize vent losses in cryogenic pump systems. This patent teaches a type of purged cryogenic pipe insulation particularly for cryogenic fluids that are less than 77 Kelvin (−321°F.).

U.S. Pat. No. 3,630,639 (Durron, et al.) also discloses a method to minimize vent losses in cryogenic pump systems. Specifically, this patent teaches the use of an automatically controlled vent valve in a vent line connected to the suction line in a cryogenic pumping system. The vent valve is in an open position during the cooldown cycle and is moved to a closed position after the system has reached desired operating conditions. Blowby gas which leaks around the piston of the pumping system provides the pressure for closing the vent valve. The vent valve contains an orifice through which the blowby gas bleeds and returns to the storage vessel for the cryogenic fluid being pumped.

It is desired to have an apparatus and a method that will minimize product losses associated with the operation of cryogenic pumps by minimizing heat leak during the pumping cycle and by more efficient means of cooling down the pump to cryogenic temperature.

It is further desired to have an apparatus and method which use an insulation for cryogenic pipe that is more durable and effective than conventional foam insulations by making use of gas vaporized during normal operation of a cryogenic tank which would otherwise be wasted.

It is still further desired to have an apparatus and a method to ensure that the cryogenic pump has a minimum net positive suction head (NPSH) at the suction without the need for elevating the cryogenic supply tank.

It also is desired to have an improved apparatus and method for transferring a fluid from a vessel to an end user which overcomes the difficulties and disadvantages of the prior art to provide better and more advantageous results.

BRIEF SUMMARY OF THE INVENTION

The invention is an apparatus and an method for transferring a fluid from a vessel. The invention also includes a method for controlling cooldown of a pump.

A first embodiment of the apparatus includes a pump having an inlet and an outlet, a first conduit having a first end and a second end, and a first control means in fluid communication with the pump and a having an open position and a closed position. The first end of the first conduit is in fluid communication with the vessel and the second end is in fluid communication with the inlet of the pump. The first control means alternates between the open position and the closed position, whereby a stream of the fluid flows into the inlet of the pump from the first conduit when the first control means first alternates to the open position, the first control means alternates to the closed position and at least part of the stream of the fluid vaporizes in the pump thereby forming a vaporized portion of the fluid, and a stream of the vaporized portion of the fluid flows out of the pump outlet when the first control means alternates again to the open position.

There are several variations of the first embodiment of the apparatus. In one variation, the fluid is a cryogenic fluid. In another variation, the vaporized portion of the fluid is transferred to the vessel.

A second embodiment of the apparatus is similar to the first embodiment but includes a temperature sensor. The sensor senses a temperature of at least a portion of the fluid in the pump or at least a portion of the fluid upstream or downstream of the pump.

A third embodiment of the apparatus is similar to the first embodiment but includes a phase separator in fluid communication with the first conduit at a first location between the first end and the second end. The phase separator is adapted to transfer a vapor stream from the first conduit to the vessel.

A fourth embodiment of the apparatus is similar to the third embodiment but includes a first layer of insulation, a second layer of insulation, a source of purge gas, a second conduit, and a second control means. The first layer of insulation peripherally surrounds the first conduit. The second layer of insulation is spaced apart from and peripherally surrounds the first layer of insulation, thereby forming a first space between the first and second layers of insulation. The second conduit has a first end in fluid communication with the source of purge gas and a second end in fluid communication with the first space. The second control means controls a flow of the purge gas from the source to the first space.

A fifth embodiment of the apparatus is similar to the first embodiment but includes a first layer of insulation, a second layer of insulation, a source of purge gas, a second conduit, and a second control means. The first layer of insulation peripherally surrounds the first conduit. The second layer of insulation is spaced apart from and peripherally surrounds the first layer of insulation, thereby forming a first space between the first and second layers of insulation. The second conduit has a first end in fluid communication with the source of purge gas and a second end in fluid communication with the first space. The second control means controls a flow of the purge gas from the source to the first space.

There are several variations of the fifth embodiment. In one variation, the source of the purge gas is in the vessel. In another variation, the first layer of insulation is a closed cell cryogenic foam. In yet another variation, at least part of the purge gas is selected from the group consisting of hydrogen, helium, argon, oxygen, hydrogen, carbon dioxide, hydrocarbons, and mixtures thereof, the hydrocarbons being selected from the group consisting of methane, ethane, butane, propane and mixtures thereof.

A sixth embodiment of the apparatus includes a pump having an inlet and an outlet, a first conduit having a first end and a second end, a phase separator, a first layer of insulation, a second layer of insulation, a source of purge gas, a second conduit, and a control means. The first end of the first conduit is in fluid communication with the vessel and the second end is in fluid communication with the inlet of the pump. The phase separator is in fluid communication with the first conduit at a first location between the first end and the second end. The phase separator is adapted to transfer a vapor stream from the first conduit to the vessel. The first layer of insulation peripherally surrounds the first conduit. The second layer of insulation is spaced apart from and peripherally surrounds the first layer of insulation, thereby forming a first space between the first and second layers of insulation. The second conduit has a first end in fluid communication with the source of purge gas and a second end in fluid communication with the first space. The control means controls a flow of the purge gas from the source to the first space.

As with the apparatus, there are various embodiments of the method for transferring a fluid from a vessel. The first embodiment of the method comprises multiple steps. The first step is to provide a pump having an inlet and an outlet. The second step is to provide a first conduit having a first end and a second end, the first end being in fluid communication with the vessel and the second end being in fluid communication with the inlet of the pump. The third step is to provide a first control means in fluid communication with the pump and having an open position and a closed position. The first control means is adapted to alternate between the open position and the closed position, whereby a stream of the fluid flows into the inlet of the pump from the first conduit when the first control means first alternates to the open position, the control means alternates to the closed position and at least a part of the stream of the fluid vaporizes in the pump thereby forming a vaporized portion of the fluid, and a stream of the vaporized portion of the fluid flows out of the pump outlet when the first control means alternates again to the open position. The fourth step is to alternate the first control means between the open position and the closed position. The fifth step is to transmit a first stream of the fluid from the first conduit to the inlet of the pump when the first control means is first in the open position. The sixth step is to transmit a first stream of the vaporized portion of the fluid out of the pump outlet when the first control means is again in the open position.

In one variation of the first embodiment of the method, the fluid is a cryogenic fluid. A second embodiment of the method includes an additional step of transmitting at least a portion of the stream of vapor to the vessel.

A third embodiment of the method is similar to the first embodiment, but includes the additional step of sensing a temperature of at least a portion of the fluid in the pump or at least a portion of the fluid upstream or downstream of the pump.

A fourth embodiment of the method is similar to the first embodiment, but includes two additional steps. The first additional step is to provide a phase separator in fluid communication with the first conduit at a first location between the first end and the second end, the phase separator being adapted to transfer a vapor stream from the first conduit to the vessel. The second additional step is to separate a stream of a vapor from at least a portion of the stream of the fluid.

A fifth embodiment of the method is similar to the first embodiment, but includes six additional steps. The first additional step is to provide a first layer of insulation peripherally surrounding the first conduit. The second additional step is to provide a second layer of insulation spaced apart from an peripherally surrounding the first layer of insulation, thereby forming a first space between the first and second layers of insulation. The third additional step is to provide a source of a purge gas. The fourth additional step is to provide a second conduit having a first end in fluid communication with the source of purge gas and a second end in fluid communication with the first space. The fifth step is to provide a second control means for controlling a flow of the purge gas from the source to the first space. The sixth step is to transmit a controlled flow of the purge gas from the source of the purge gas to the first space.

There are several variations of the fifth embodiment of the method. In a first variation, the first layer of insulation is a closed cell cryogenic foam. In a second variation, the source of the purge gas is in the vessel. In another variation, the purge gas is selected from the group consisting of nitrogen, helium, argon, oxygen, hydrogen, carbon dioxide, hydrocarbons, and mixtures thereof, the hydrocarbons being selected from the group consisting of methane, ethane, butane, propane and mixtures thereof.

A sixth embodiment of the method includes multiple steps. The first step is to provide a pump having an inlet and an outlet. The second step is to provide a first conduit having a first end and a second end, the first end being in fluid communication with the vessel and the second end being in fluid communication with the inlet of the pump. The third step is to provide a phase separator in fluid communication with the first conduit at a first location between the first end and the second end, the phase separator adapted to transfer a vapor stream from the first conduit to the vessel. The fourth step is to provide a first layer of insulation peripherally surrounding the first conduit. The fifth step is to provide a second layer of insulation spaced apart from and peripherally surrounding the first layer of insulation, thereby forming a first space between the first and second layers of insulation. The sixth step is to provide a source of a purge gas. The seventh step is to provide a second conduit having a first end in fluid communication with the source of purge gas and a second end in fluid communication with the first space. The eighth step is to provide a control means for controlling a flow of the purge gas from the source to the first space. The ninth step is to transmit a first stream of the fluid from the vessel to the first conduit. The tenth step is to separate a stream of a vapor from at least a portion of the first stream of the fluid. The eleventh step is to transmit a controlled flow of the purge gas from the source of the purge gas to the first space.

Another aspect of the invention is a method for controlling cooldown of a pump having an outlet and an inlet in communication with a source of a fluid. The method includes multiple steps. The first step is to provide a control means in fluid communication with the pump and having an open position and a closed position. The control means is adapted to alternate between the open position and the closed position, whereby a stream of the fluid flows into the inlet of the pump from the source when the control means first alternates to the open position, the first control means alternates to the closed position and at least part of the stream of the fluid vaporizes in the pump thereby forming a vaporized portion of the fluid, and a stream of the vaporized portion of the fluid flows out of the pump outlet when the control means alternates again to the open position. The second step is to alternate the control means between the open position and the closed position. The third step is to transmit a stream of the fluid from the source of the inlet of the pump when the control means first is in the open position. The fourth step is to transmit a stream of the vaporized portion of the fluid out of the pump outlet when the control means is again in the open position.

There are several variations of the method for controlling cooldown of a pump. In one variation, the fluid is a cryogenic fluid. In another variation, the step of alternating the control means between the open and closed positions includes five sub-steps. The first sub-step is to designate a setpoint for a variable temperature, the temperature to be determined in the pump or at a location upstream or downstream of the pump. The second sub-step is to provide a sensing means for sensing the temperature. The third sub-step is to move the control means to the open position, thereby allowing a stream of the fluid to flow into the inlet of the pump. The fourth sub-step is to move the control means to the closed position when a designated amount of fluid has flowed into the inlet of the pump. The fifth sub-step is to move the control means back to the open position when the temperature sensed by the sensing means is less than the set point.

Another embodiment of the method for controlling cooldown of a pump is similar to the first embodiment of that method but includes the additional step of sensing a temperature of at least a portion of the fluid in the pump or at least a portion of the fluid upstream or downstream of the pump.

BRIEF DESCRIPTION OF THE DRAWINGS

The invention will be described by way of example with reference to the accompanying drawings, in which.

DETAILED DESCRIPTION OF THE INVENTION

The invention is a pumping system and a method for operating the pumping system to minimize the amount of product lost by the system during operation and cooldown. The invention includes various features which, when combined, minimize the loss of product. Although the invention may be used with various types of fluids, it is particularly useful with cryogenic fluids.

Cryogenic temperatures are measured on the absolute or Kelvin scale in which absolute zero is 0 K. The cryogenic temperature range is from about −150° C. (−238° F.) to absolute zero (−273° C. or −460° F.), or about 123 K to 0 K.

The invention is described herein with regard to cryogenic fluids; but persons skilled in the art will recognize that the invention is not limited to use with cryogenic fluids. (For example, the invention could be used with relatively cold fluids having temperatures higher than the temperatures of "cryogenic fluids," but which would change phase in the system in a manner similar to that described below for cryogenic fluids.) A double-acting, two-stage pump that works particularly well with the system and method of this invention is discussed in a patent application Ser. No. 09/825,823 being filed concurrently with this application and which is entitled "Double-Acting, Two-Stage Pump", which patent application is incorporated herein by reference.

The key features of the invention, when used with cryogenic fluids, are:

1) An inlet line supplying liquid cryogen to a pump is insulated and is purged using gas from a supply tank that has boiled off and would otherwise be wasted by venting to atmosphere. Alternatively, a separate source of inert gas may be used.
2) The inlet line has a phase separator that only allows vapor to return to the supply tank such that the vapor return line need not be insulated.
3) The pump is cooled down by automatically opening, then closing, in an alternating manner, a valve (pump unloader valve) downstream of the pump so that liquid can be brought into the pump and allowed to boil off slowly, thus making more efficient use of the refrigeration value of the cryogen. This is monitored by a temperature probe or sensor mounted on the pump assembly. Alternatively, the temperature may could be mounted in the upstream or downstream piping. The pump unloader valve normally discharges to atmosphere, although the pump also can be made to run during this cycle and the pump unloader valve can return product to the supply tank.

Figure 1:
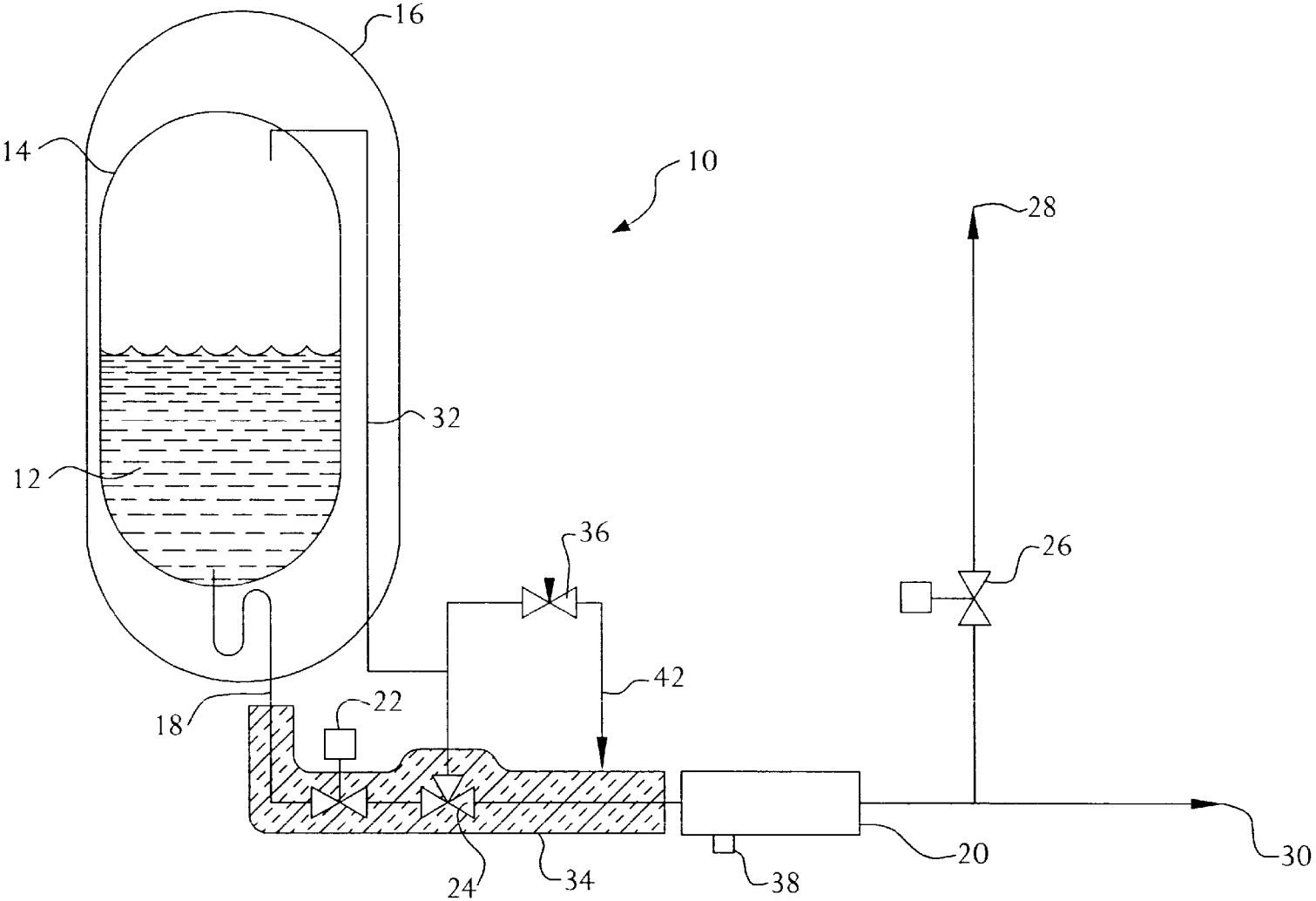
FIG. 1 is a schematic representation illustrating one embodiment of the present invention.
Figure 2:
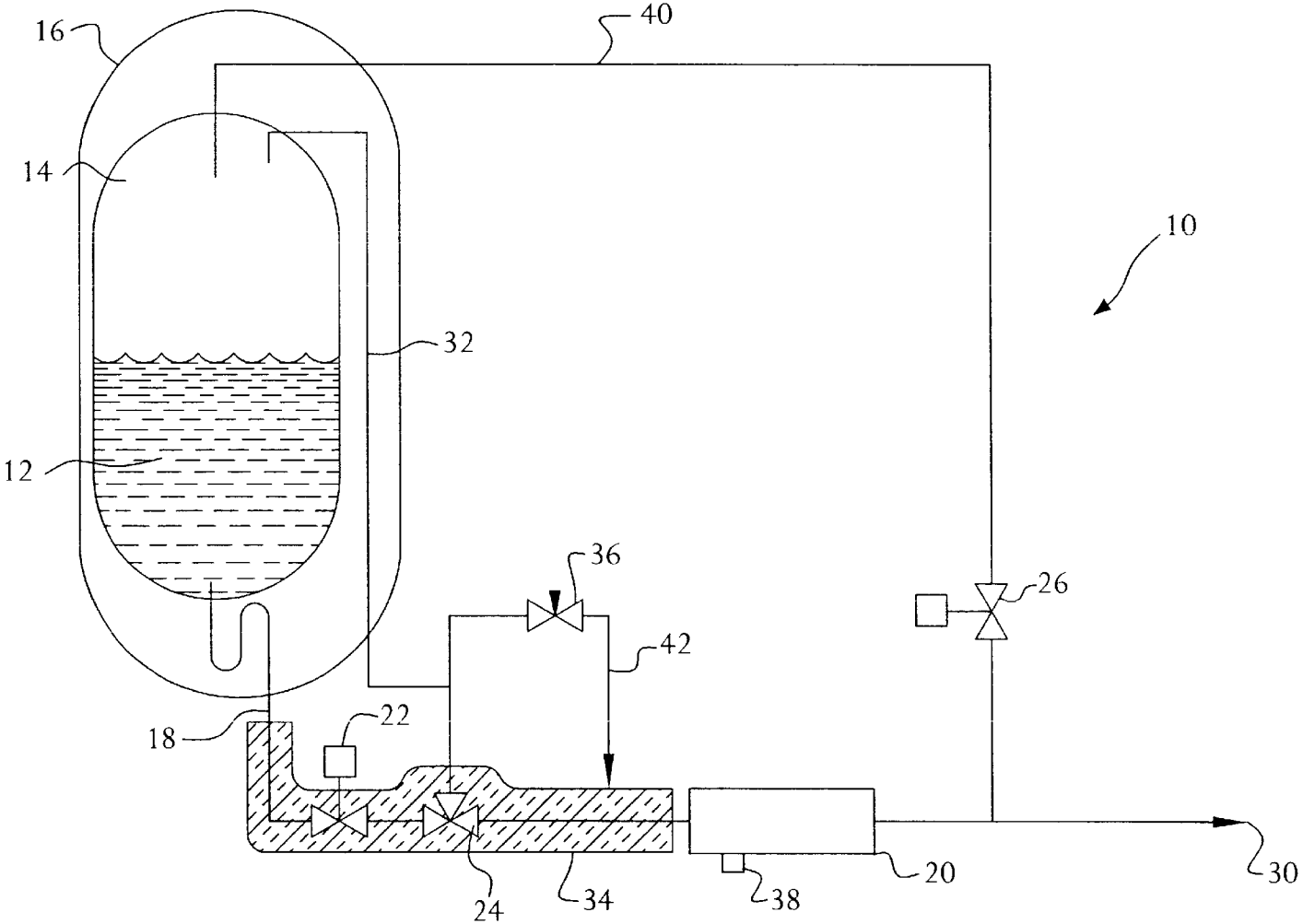
FIG. 2 is a schematic representation illustrating a second embodiment of the present invention.
Figure 3:
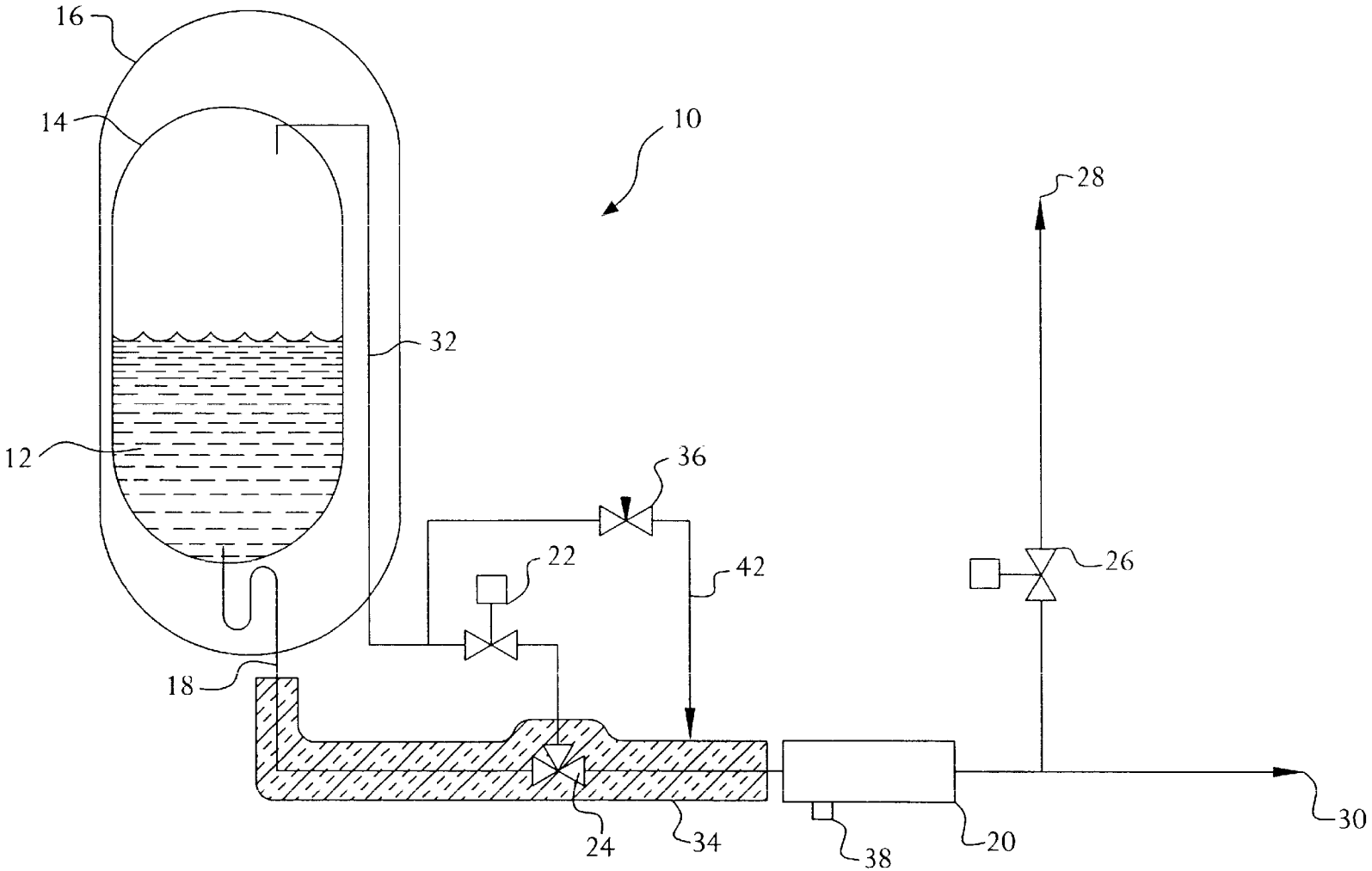
FIG. 3 is a schematic representation illustrating a third embodiment of the present invention.

One embodiment of the system 10 is illustrated in FIG. 1. Alternate embodiments are shown in FIGS. 2 and 3.

Referring to the system 10 in FIG. 1, the cryogenic fluid 12 is stored in a supply tank 14 which is encased in a larger tank 16. The fluid is transferred from the supply tank to a pump 20 by an inlet line 18. A suction valve 22 in the inlet line may be used to control the flow of fluid from the supply tank to the pump via the inlet line. A phase separator 24 in the inlet line separates vapor from the liquid in the fluid. The liquid flows to the pump inlet, and the vapor is returned to the supply tank via a vapor return line 32. The pump 20 is cooled down by automatically opening and then closing in an alternating manner a pump unloader valve 26 located downstream of the pump outlet. The pump unloader valve is in the open position and liquid flows into the pump when the temperature reaches a setpoint, as measured by the temperature probe 38. The pump unloader valve moves to the open position and the vapor which boiled off the liquid in the pump is vented to the atmosphere 28. The liquid discharged from the pump is transmitted to another location 30 in the system which may be an end user, a tank, etc. (not shown).

Figure 4:
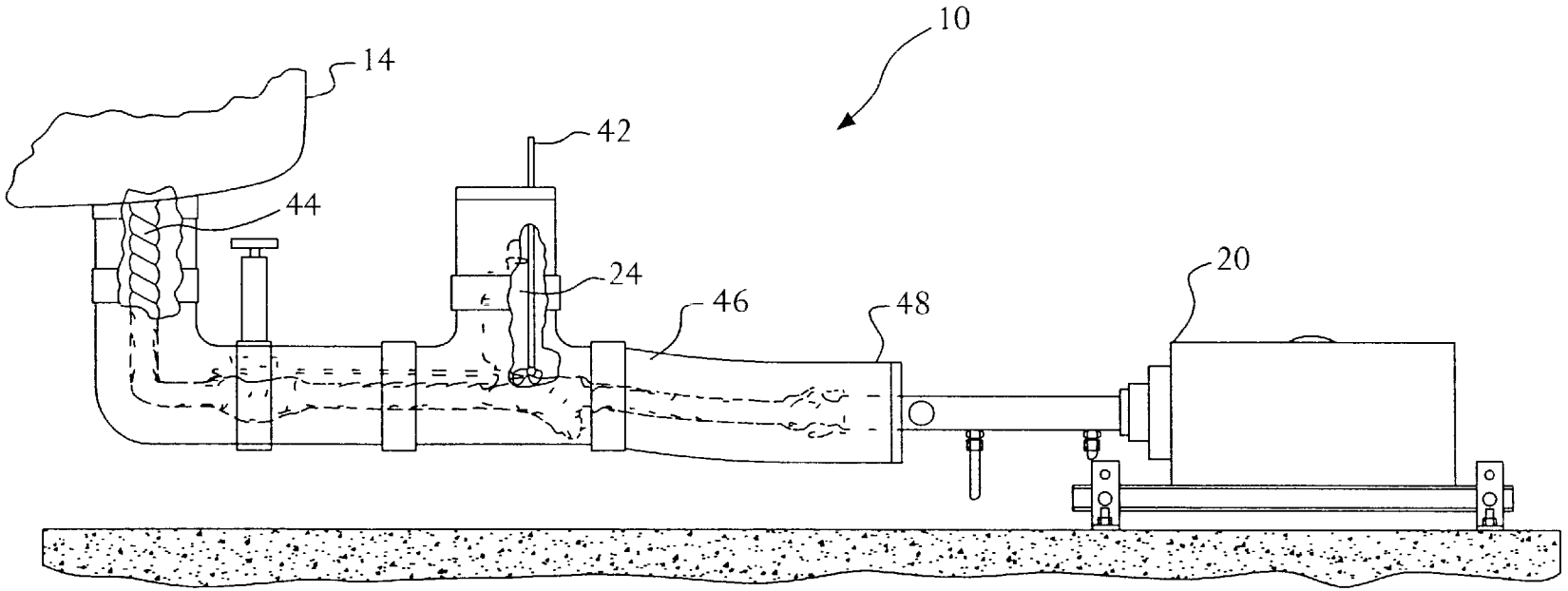
FIG. 4 is a schematic representation illustrating the multiple layers of insulation used in the present invention.

As shown in FIG. 1, the inlet line 18 is insulated, and as shown further in FIG. 4, the insulation 34 actually comprises multiple layers. The first layer of insulation 44 is a closed cell cryogenic foam insulation capable of handling the low temperatures of cryogenic fluids. The second layer of insulation 46 preferably is an open cell foam insulation, although a closed cell type of insulation also is acceptable. Because this second layer of insulation typically does not have to handle lower temperature fluids as does the first layer of insulation, an open cell polyurethane foam insulation is preferred for the second layer of insulation. In the space between the first and second layers of insulation, an inert gas, such as nitrogen, argon or helium, is used for a purge. Many other gases could be used for the purge gas, including but not limited to carbon dioxide, oxygen, hydrogen, and certain hydrocarbons (e.g., methane, ethane, butane, propane and mixtures thereof). Although the inert and non-flammable gases are preferred, use of the other gases would be feasible if non-flammable types of insulation are used.

The purge gas permeates the second layer of insulation 46 (the open cell foam), but remains relatively stagnant around the first layer of insulation 44 (the closed cell foam). The outer layer (third layer) of insulation 48 acts as a rain barrier and also is used to contain the purge gas. The purge gas is admitted to the space between the first and second layers of insulation via the conduit 42 connected to the supply tank 14 from which the purge gas is withdrawn. Flow of the purge gas is controlled by the insulation purge flow control valve 36.

FIGS. 2 and 3 show alternate embodiments of the system 10. The alternate embodiment shown in FIG. 2 is similar to the embodiment in FIG. 1, except that the vapor from the pump unloader valve 26 is re-circulated to the top of the supply tank 14 via conduit 40. The second alternate embodiment of the system 10 shown in FIG. 3 is similar to the embodiment in FIG. 1, except that the pump suction valve 22 is located between the supply tank 14 and the phase separator 24.

A key feature of the system 10 is the multi-layer design of the insulation 34. The insulation is most applicable to situations where a source of dry nitrogen or other inert gas is available that can be used for a purge where this gas otherwise might be vented to atmosphere and thus wasted. Cryogenic tanks supplying cryogenic pumping systems typically vent gas due to the heat input to the tank which boils off liquid. That gas can not be consumed by the pump, and is often too great a quantity to simply fill the volume of the removed liquid and so it must be vented.

Another key feature of the system 10 is the use of a mechanical phase separator 24 on the inlet line 18 near the pump 20, as shown in FIGS. 1–4. In the preferred embodiment, this device is a valve connected to a float which allows vapor only (not liquid) that boils off in the inlet line to travel back to the vapor space of the supply tank 14. By providing this device in the inlet line, the piping of the vapor return line 32 is greatly simplified. First, there is no need for insulation on the vapor return line. This reduces cost, more than making up for the added cost of the phase separator. Second, the vapor return line does not have to be carefully laid out to ensure that there are no liquid traps in the line. A liquid trap in the vapor return line can easily prevent vapor from rising up the vapor return line to the top of the tank, thus creating a bubble that forces liquid out of the inlet line. The result is that the pump could have gas at the inlet instead of liquid, resulting in the pump not being able to operate.

A third key feature of the system 10 is the method of controlling cooldown of the pump 20. The system is controlled and monitored to minimize the amount of product used for cooldown of the pump. To get liquid into the pump, the pump unloader valve 26 opens to atmosphere 28 downstream of the pump allowing liquid to flow into and through the pump. The pump unloader valve is then shut to allow this standing liquid to boil off inside the pump, thus cooling down the pump. The pump unloader valve is made to operate in an alternating manner as required to ensure that there is liquid inside the pump for cooling. When the pump temperature has reached a desired setpoint, the pump unloader valve opens again to vent any vapor inside the pump, and then the valve closes and the pump is allowed to run. Alternatively, vapor transmitted from the pump unloader valve can be routed back to the supply tank 14 at the top, the bottom, or another location of the tank. At the same time that the pump unloader valve is opened, the pump can be turned on and the fluid routed back to the supply tank. This alternative is shown in FIG. 2 for the case where the vapor transmitted from the pump unloader valve is routed back to the top of the tank.

The pump unloader valve 26 is pulsed, rather than kept open. By doing this, the cryogenic liquid has more time to exchange heat with the pump 20 and the piping, thus using more of the refrigeration capacity of the cryogenic liquid.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. An apparatus for transferring a fluid from a vessel, comprising:

a pump having an inlet and an outlet;

a first conduit having a first end and a second end, the first end being in fluid communication with the vessel and the second end being in fluid communication with the inlet of the pump; and a first control means in fluid communication with the pump and having an open position and a closed position, the first control means alternating between the open position and the closed position, whereby a stream of the fluid flows into the inlet of the pump from the first conduit when the first control means first alternates to the open position, the first control means alternates to the closed position and at least part of said stream of the fluid vaporizes in the pump thereby forming a vaporized portion of the fluid, and a stream of the vaporized portion of the fluid flows out of the pump outlet when the first control means alternates again to the open position.

2. An apparatus as in claim 1, further comprising:

a phase separator in fluid communication with the first conduit at a first location between the first end and the second end, the phase separator adapted to transfer a vapor stream from the first conduit to the vessel.

3. An apparatus as in claim 2, further comprising:

a first layer of insulation peripherally surrounding the first conduit;

a second layer of insulation spaced apart from and peripherally surrounding the first layer of insulation, thereby forming a first space between the first and second layers of insulation;

a source of purge gas;

a second conduit having a first end in fluid communication with the source of purge gas and a second end in fluid communication with the first space; and a second control means for controlling a flow of the purge gas from the source to the first space.

4. An apparatus as in claim 1, further comprising:

a first layer of insulation peripherally surrounding the first conduit;

a second layer of insulation spaced apart from and peripherally surrounding the first layer of insulation, thereby forming a first space between the first and second layers of insulation;

a source of purge gas;

a second conduit having a first end in fluid communication with the source of purge gas and a second end in fluid communication with the first space; and a second control means for controlling a flow of the purge gas from the source to the first space.

5. An apparatus as in claim 4, wherein the source of the purge gas is in the vessel.

6. An apparatus as in claim 4, wherein at least part of the purge gas is selected from the group consisting of nitrogen, helium, argon, oxygen, hydrogen, carbon dioxide, hydrocarbons, and mixtures thereof, said hydrocarbons being selected from the group consisting of methane, ethane, butane, propane and mixtures thereof.

7. An apparatus as in claim 4, wherein the first layer of insulation is a closed cell cryogenic foam.

8. An apparatus as in claim 1, wherein the vaporized portion of the fluid is transferred to the vessel.

9. An apparatus as in claim 1, further comprising a temperature sensor for sensing a temperature of at least a portion of the fluid in the pump or at least a portion of the fluid upstream or downstream of the pump.

10. An apparatus as in claim 1, wherein the fluid is a cryogenic fluid.

11. An apparatus for transferring a fluid from a vessel, comprising:

a pump having an inlet and an outlet;

a first conduit having a first end and a second end, the first end being in fluid communication with the vessel and the second end being in fluid communication with the inlet of the pump; p1 a phase separator in fluid communication with the first conduit at a first location between the first end and the second end, the phase separator adapted to transfer a vapor stream from the first conduit to the vessel;

a first layer of insulation peripherally surrounding the first conduit;

a second layer of insulation spaced apart from and peripherally surrounding the first layer of insulation, thereby forming a first space between the first and second layers of insulation;

a source of purge gas;

a second conduit having a first end in fluid communication with the source of purge gas and a second end in fluid communication with the first space; and a control means for controlling a flow of the purge gas from the source to the first space.

12. A method for transferring a fluid from a vessel, comprising the steps of:

providing a pump having an inlet and an outlet;

providing a first conduit having a first end and a second end, the first end being in fluid communication with the vessel and the second end being in fluid communication with the inlet of the pump;

providing a first control means in fluid communication with the pump and having an open position and a closed position, the first control means adapted to alternate between the open position and the closed position, whereby a stream of the fluid flows into the inlet of the pump from the first conduit when the first control means first alternates to the open position, the first control means alternates to the closed position and at least part of said stream of the fluid vaporizes in the pump thereby forming a vaporized portion of the fluid, and a stream of the vaporized portion of the fluid flows out of the pump outlet when the first control means alternates again to the open position;

alternating the first control means between the open position and the closed position;

transmitting a first stream of the fluid from the first conduit to the inlet of the pump when the first control means is first in the open position; and transmitting a first stream of the vaporized portion of the fluid out of the pump outlet when the first control means is again in the open position.

13. A method as in claim 12, comprising the further steps of:

providing a phase separator in fluid communication with the first conduit at a first location between the first end and the second end, the phase separator adapted to transfer a vapor stream from the first conduit to the vessel; and separating a stream of a vapor from at least a portion of the stream of the fluid.

14. A method as in claim 12, comprising the further steps of:

providing a first layer of insulation peripherally surrounding the first conduit;

providing a second layer of insulation spaced apart from and peripherally surrounding the first layer of insulation, thereby forming a first space between the first and second layers of insulation;

providing a source of a purge gas;

providing a second conduit having a first end in fluid communication with the source of purge gas and a second end in fluid communication with the first space;

providing a second control means for controlling a flow of the purge gas from the source to the first space; and transmitting a controlled flow of the purge gas from the source of the purge gas to the first space.

15. A method as in claim 14, wherein the source of the purge gas is in the vessel.

16. A method as in claim 14, wherein the purge gas is selected from the group consisting of nitrogen, helium, argon, oxygen, hydrogen, carbon dioxide, hydrocarbons, and mixtures thereof, said hydrocarbons being selected from the group consisting of methane, ethane, butane, propane and mixtures thereof.

17. A method as in claim 14, wherein the first layer of insulation is a closed cell cryogenic foam.

18. A method as is claim 12, comprising the further step of transmitting at least a portion of the stream of vapor to the vessel.

19. A method as in claim 12, comprising the further step of sensing a temperature of at least a portion of the fluid in the pump or at least a portion of the fluid upstream or downstream of the pump.

20. A method as in claim 12, wherein the fluid is a cryogenic fluid.

21. A method for transferring a fluid from a vessel, comprising the steps providing a pump having an inlet and an outlet;

providing a first conduit having a first end and a second end, the first end being in fluid communication with the vessel and the second end being in fluid communication with the inlet of the pump;

providing a phase separator in fluid communication with the first conduit at a first location between the first end and the second end, the phase separator adapted to transfer a vapor stream from the first conduit to the vessel;

providing a first layer of insulation peripherally surrounding the first conduit;

providing a second layer of insulation spaced apart from and peripherally surrounding the first layer of insulation, thereby forming a first space between the first and second layers of insulation;

providing a source of a purge gas;

providing a second conduit having a first end in fluid communication with the source of purge gas and a second end in fluid communication with the first space;

providing a control means for controlling a flow of the purge gas from the source to the first space;

transmitting a first stream of the fluid from the vessel to the first conduit;

separating a stream of a vapor from at least a portion of the first stream of the fluid; and transmitting a controlled flow of the purge gas from the source of the purge gas to the first space.

22. A method for controlling cooldown of a pump having an outlet and an inlet in communication with a source of a fluid, comprising the steps of:

providing a control means in fluid communication with the pump and having an open position and a closed position, the control means adapted to alternate between the open position and the closed position, whereby a stream of the fluid flows into the inlet of the pump from the source when the control means first alternates to the open position, the first control means alternates to the closed position and at least part of said stream of the fluid vaporizes in the pump thereby forming a vaporized portion of the fluid, and a stream of the vaporized portion of the fluid flows out of the pump outlet when the control means alternates again to the open position;

alternating the control means between the open position and the closed position;

transmitting a stream of the fluid from the source to the inlet of the pump when the control means first is in the open position; and transmitting a stream of the vaporized portion of the fluid out of the pump outlet when the control means is again in the open position.

23. A method as in claim 22, comprising the further step of sensing a temperature of at least a portion of the fluid in the pump or at least a portion of the fluid upstream or downstream of the pump.

24. A method as in claim 22, wherein the fluid is a cryogenic fluid.

25. A method for controlling cooldown of a pump as in claim 22, wherein the step of alternating the control means between the open and closed positions comprises the sub-steps of:

(a) designating a setpoint for a variable temperature, the temperature to be determined in the pump or at a location upstream or downstream of the pump;

(b) providing a sensing means for sensing the temperature;

(c) moving the control means to the open position, thereby allowing a stream of the fluid to flow into the inlet of the pump;

(d) moving the control means to the closed position when a designated amount of fluid has flowed into the inlet of the pump; and (e) moving the control means back to the open position when the temperature sensed by the sensing means is less than the setpoint.

* * * * *